United States Patent [19]

Shabtai et al.

[11] 4,037,440

[45] July 26, 1977

[54] SECURITY LOCK FOR DOORS

[76] Inventors: Joseph Shabtai, 41 Geulim St., Holon; Simon Assaraf, 91 Rothschild St., Rishon Lezion, both of Israel

[21] Appl. No.: 593,554

[22] Filed: July 7, 1975

[30] Foreign Application Priority Data

June 25, 1975 Israel ..... 47557

[51] Int. Cl.[2] ..... E05B 59/00

[52] U.S. Cl. ..... 70/108; 70/82; 70/120; 292/37; 292/39

[58] Field of Search ..... 70/120, 118, 107, 108, 70/82, 110, 111; 292/34, 37, 39, 36, 165

[56] References Cited

U.S. PATENT DOCUMENTS

| | | | |
|---|---|---|---|
| 738,280 | 9/1903 | Bell et al. | 70/108 |
| 2,473,065 | 6/1949 | Miller | 292/37 |
| 3,776,581 | 12/1973 | Ross, Jr. | 292/39 |

FOREIGN PATENT DOCUMENTS

| | | | |
|---|---|---|---|
| 353,987 | 5/1922 | Germany | 292/39 |
| 6,832 | 5/1835 | United Kingdom | 70/118 |

*Primary Examiner*—Paul R. Gilliam
*Assistant Examiner*—Kenneth J. Dorner
*Attorney, Agent, or Firm*—Benjamin J. Barish

[57] ABSTRACT

A locking device mountable within a door in a door frame, comprises a casing including a pair of side plates, a toothed-wheel rotatably disposed between the side plates, and a plurality of locking bars coupled to the toothed-wheel and projectable thereby into locking engagement with the door frame. The toothed-wheel is formed with a cam surface for each locking bar, each locking bar carrying at its inner end a cam follower movable along the respective cam surface of the toothed-wheel. The side plates are formed with guiding slots for each locking bar guiding the movement thereof such that the rotation of the toothed-wheel in one direction projects the outer ends of the locking bars from the door into locking engagement with the door frame, and the rotation of the toothed-wheel in the opposite direction withdraws the locking bars into the door.

According to a further feature, the locking device is a rim lock actuated by a key and mountable adjacent to one side of the door, one of the locking bars being a locking bolt projectable from and withdrawable into that side of the door, the remaining locking bars being locking rods projectable from and withdrawable into the remaining three sides of the door.

3 Claims, 5 Drawing Figures

FIG.3
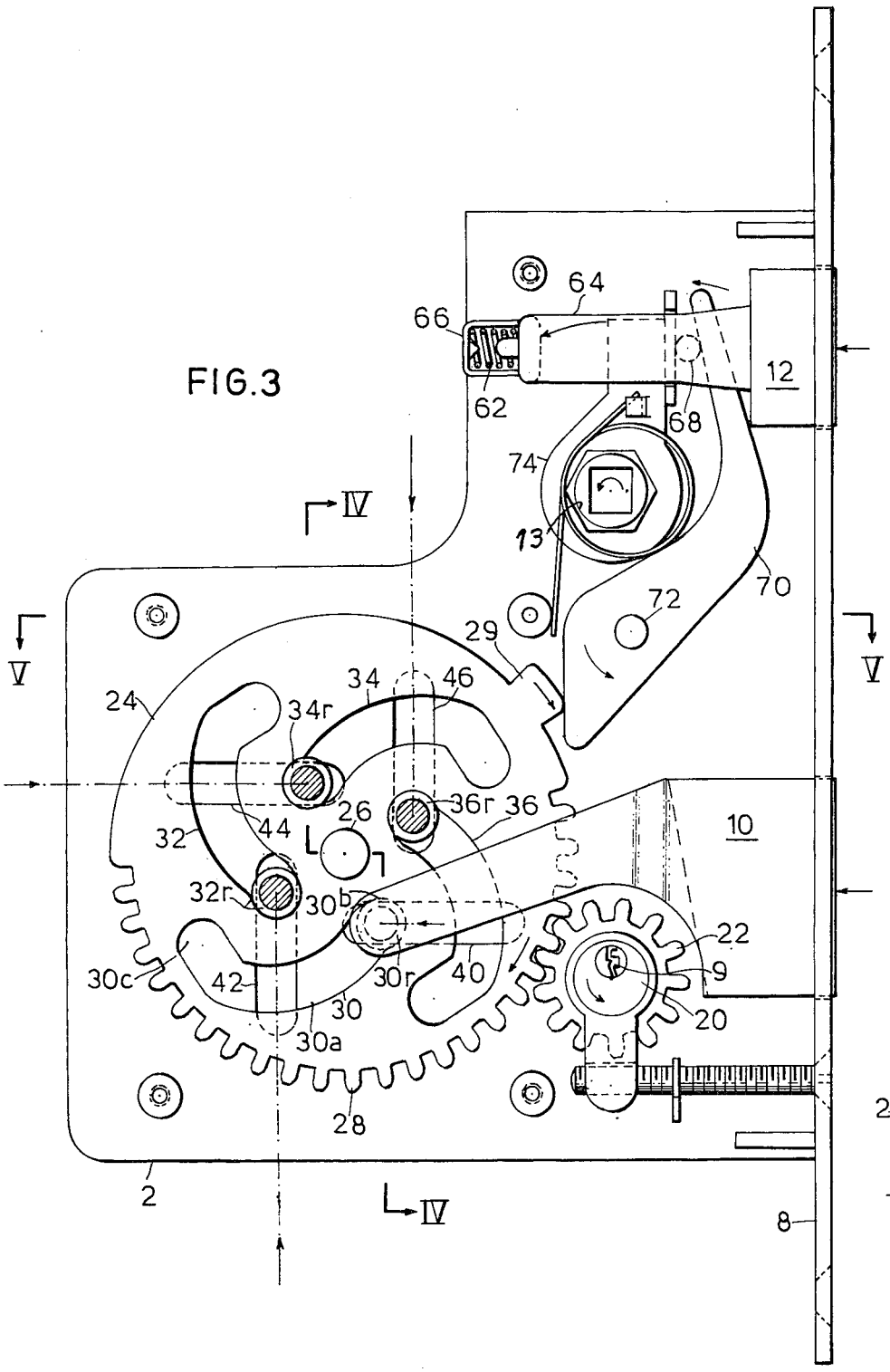
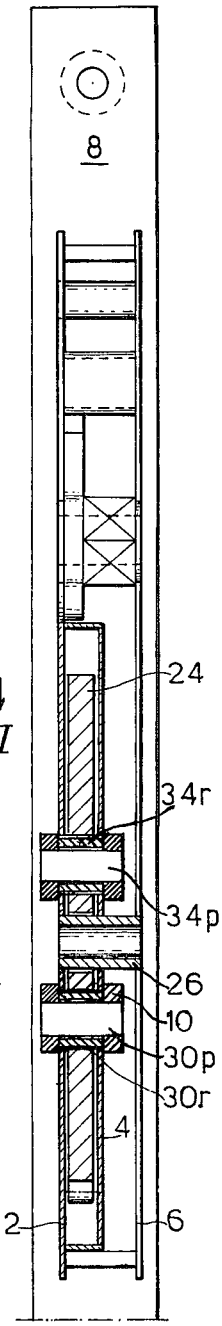
FIG.4
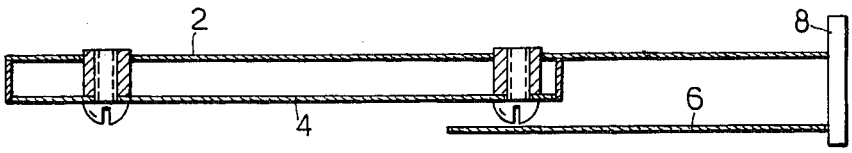
FIG.5

SECURITY LOCK FOR DOORS

BACKGROUND OF THE INVENTION

The present invention relates to door locking devices of the type which include a plurality of bars projectable from all sides of the door into recesses formed in the door frame. The invention is particularly useful with respect to key-operated rim locks mountable adjacent to one side of the door, and is therefore described below in connection with that application.

An object of the present invention is to provide a novel locking device of the foregoing type having an arrangement which makes it extremely difficult, if possible at all, to open the lock by forcing one of the locking bars to its withdrawn position. Another object of the invention is to provide a locking device which enables the user to use a single key for operating both the rim lock and also the locking bars, thereby relieving the user of carrying two keys and of making two manipulations in order to lock and unlock the door.

SUMMARY OF THE INVENTION

According to the present invention, there is provided a locking device mountable within a door in a door frame, comprising: a casing including a pair of side plates, a toothed-wheel rotatably disposed between the side plates, and a plurality of locking bars coupled to said toothed-wheel and projectable thereby into locking engagement with the door frame; the improvement wherein said toothed-wheel is formed with a cam surface for each locking bar, each locking bar carrying at its inner end a cam follower movable along the respective cam surface of the toothed-wheel, at least one of the side plates being formed with a guiding slot for each locking bar guiding the movement thereof such that the rotation of the toothed-wheel in one direction projects the outer ends of the locking bars from the door into locking engagement with the door frame, and the rotation of the toothed-wheel in the opposite direction withdraws the locking bars into the door.

According to another feature, the locking device is a rim lock actuated by a key and mountable adjacent to one side of the door, one of said locking bars being a locking bolt projectable from and withdrawable into said one side of the door, the remaining locking bars being locking rods projectable from and withdrawable into the remaining three sides of the door.

BRIEF DESCRIPTION OF THE DRAWINGS

The invention is herein described, by way of example only, with reference to the accompanying drawings, wherein:

FIG. 3 is a view corresponding to that of FIG. 2 with parts removed to show internal structures;

FIG. 4 is a sectional view along lines IV — IV of FIG. 3 but with the removed parts present, and FIG. 5 is a corresponding sectional view along lines V — V of FIG. 3.

DESCRIPTION OF THE PREFERRED EMBODIMENT

Figure 1:
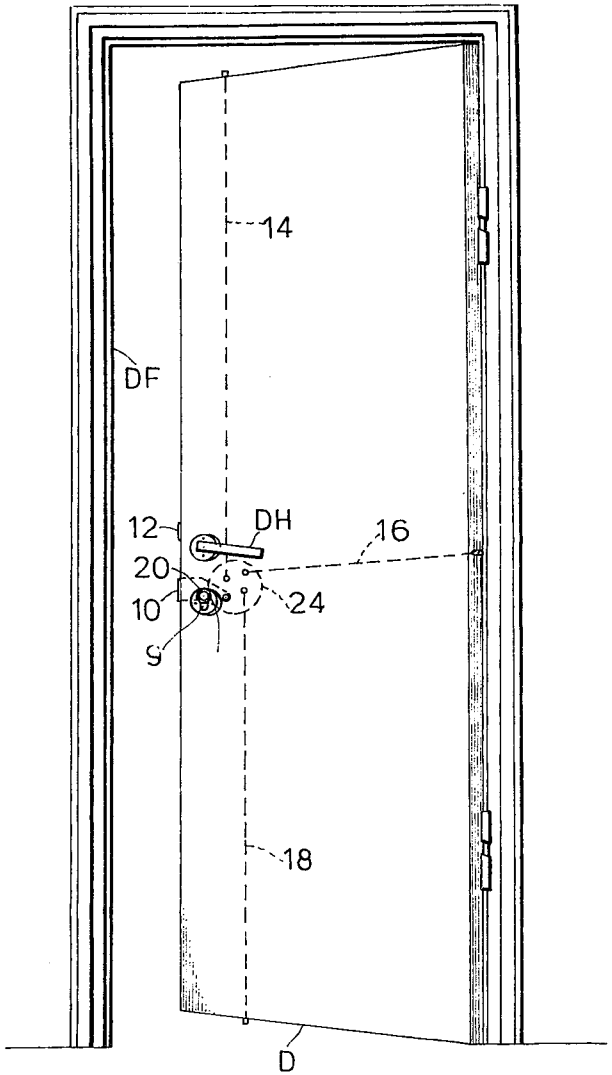
FIG. 1 illustrates a door including a locking device constructed in accordance with the invention.
Figure 2:
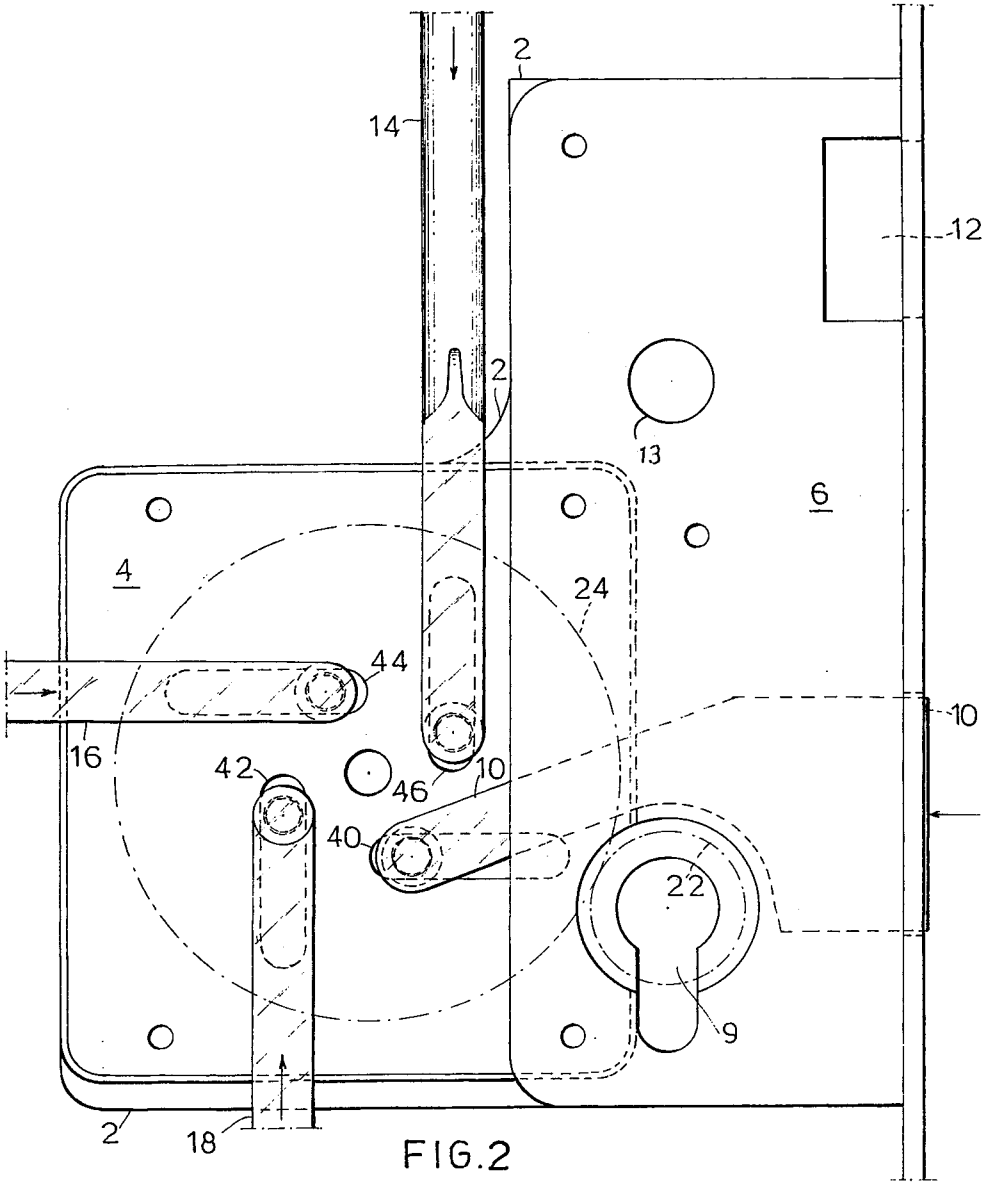
FIG. 2 is a side elevational view of the locking device of FIG. 1.

The locking device illustrated in the drawings comprises a casing including three side plates 2,4,6, and a face plate 8. The lock is mounted within a recess formed in the door D (FIG. 1) with the face plate 8 flush with and fastened to the door edge. Side plates 2 and 6 are formed with a keyhole 9 permitting the introduction of the proper key, when when rotated, moves a bolt 10 and also a tongue 12 into their projected (locking) positions with respect to the door frame DF, or to their withdrawn (unlocking) positions within the door. In addition, the side plates 2 and 6 include an opening 13 for the door handle DH which may be pivoted to withdraw tongue 12 from the door recess.

The lock further includes a plurality of locking bars or rods 14, 16, 18, which may also be projected from or withdrawn into the remaining sides of the door in order to lock or unlock the door by the rotation of the proper key within keyhole 9.

In the novel lock construction illustrated in the drawings, the cylinder 20 which is rotated by the proper key includes a gear 22 (FIG. 3) meshing with a toothed-wheel 24 rotatably mounted on axle 26 between side plates 2 and 4. Wheel 24 is formed along about one-half of its circumference with a plurality of teeth 28 meshing with gear 22, and with an abutment or lug 29 at the un-toothed portion.

Wheel 24 is further formed with four closed cam slots 30, 32, 34, 36. When the wheel is rotated in one direction, these slots are effective to project bolt 10 and locking rods 14, 16, 18 outwardly so that their outer ends are brought into locking engagement with the door frame DF by entering recesses therein; and when the toothed-wheel is rotated in the opposite direction, these slots are effective to withdraw the locking bolt and the rods from the door frame. For this purpose, locking bar 10 and the three locking rods each carry, at their inner ends, a roller **30*r*, 32*r*, 34*r*, 36*r* movable within cam slots 30, 32, 34, 36, which rollers are also movable within guiding slots 40, 42, 44, 46 in side plate 4 (FIG. 4), and within corresponding guiding slots in side plate 2. The rollers are each pivotably secured to their respective locking bolt (10) and locking rods (14, 16, 18) by means of a pin, e.g. 34*p* for roller 34*r*.**

Tongue 12 is urged to its projected position by a spring 62 (FIG. 3) interposed between an extension 64 carried by the tongue, and a seat 66 carried between side plates 2 and 6. Tongue extension 64 includes a pin 68 engageable by one end of a lever 70 pivoted at 72. The opposite end of the lever is engageable by the previously mentioned lug 29 carried by toothed-wheel 24, such that when the toothed-wheel 24 is rotated in the clockwise direction, lug 29 engages the end of lever 70 pivoting same to move tongue 12 to its withdrawn or unlocking position against spring 62. Tongue 12 may also be withdrawn by rotation of the door handle DH within opening 13 which pivots another lever 74 to cause the tongue to withdraw against spring 62.

Each of the cam slots, 30, 32, 34, 36 (FIG. 3) formed within toothed-wheel 24 includes three portions, namely (with reference to cam slot 30 allocated to locking bolt 10); (a) a main portion **30*a* which effects the projecting and withdrawal movements of the locking bolt 10; (b) a dwell portion 30*b* at the inner end of the slot which causes the locking bolt, after completing its withdrawal movement, to dwell while the tooth wheel 24 is further rotated to bring abutment 29 into engagement with lever 70 to withdraw tongue 12; and (c) a locking portion 30*c* at the outer end of the slot effective, when the locking bolt has completed its projecting movement, to lock same in the projected position against any counter-force that may be applied to the locking bolt. The other slots 32, 34 and 36 are similarly configured to cooperate in the same manner with their locking rods 14, 16 and 18.**

The locking device illustrated in the drawings is operated in the following manner:

First, assuming that the locking bolt 10 and the three locking rods 14, 16, 18 are in their withdrawn or unlocking positions, the door would normally be locked by tongue 12 urged by spring 62 to project from the door D into the recess in the door frame DF, but may be unlocked by pivoting the door handle DH within openings 13, which pivots lever 74 to move tongue 12 to its withdrawn position.

When locking bolt 10 and the three locking rods 14, 16, 18 are in their withdrawn or unlocking positions, there respective rollers 30*r*, 32*r*, 34*r*, 36*r* are seated within the inner portions of their respective cam slots 30, 32, 34, 36, formed within tooth-wheel 24. Thus, roller 30*p* for locking bar 10 would be seated within the inner dwell portion 30*b* of its respective cam slot 30.

Now, when the door is to be securely locked by means of the key, the key is inserted into the keyhole 9 and is rotated in the clockwise direction with respect to FIG. 3. This rotates toothed wheel 24 in the counter-clockwise direction causing the four rollers 30*r*, 32*r*, 34*r*, 36*r* at the ends of locking bolt 10 and the three locking rods 14, 16, 18, to move along the intermediate portions (.e.g. 30*a*) of their respective slots 30, 32, 34, 36, thereby causing the bolt and the rods to be projected outwardly of their respective sides of the door into recesses in the door frame. This movement of the rollers, and of the locking bolt and rods, is guided by slots 40, 42, 44, 46 in side plate 4 and the corresponding slots in side plate 2.

The projecting movement of the locking bolt and of the locking rods is completed just as their respective rollers move to the outer extremity of the main portion (e.g. 30*a*) of their cam slots, at which time they enter the outermost portion (e.g. 30*c*) of their respective cam slots. These latter portions of the cam slots are designed so as to effect an overcenter locking of the respective bar or rods, such that if a counter-force is applied to the respective bar or rod, this counter-force will not tend to rotate the toothed-wheel in the return direction (i.e., clockwise), but rather in the forward direction (i.e., counter-clockwise). However, this rotation of the wheel is restrained by the end of the respective slot.

Thus, when the locking bolt and rods are in their projected positions, should someone try to force the lock open by applying a large force against either the locking bar 10 or one of the locking rods 14, 16, 18, the most he will be able to do is break one of the pins (e.g. 30*p*) to which the respective bar or rod is attached to its roller, and will not be able to rotate the toothed-wheel 24 in order to withdraw the other locking rods or the bolt. The door can thus be released only by the use of the proper key to rotated wheel 24, unless all the rods 14, 16, 18 as well as locking bolt 10, are individually forced open, which would be very difficult and time consuming to achieve.

To open the lock, the key is rotated in the counter-clockwise direction, thereby rotating tooth-wheel 24 clockwise, causing the rollers 30*r*, 32*r*, 34*r*, 36*r* to move from their outermost portions (e.g. 30*c*) of their respective slots, through their main portions (e.g. 30*a*) which causes the respective bolt and rods to be withdrawn, and finally to their innermost portions (e.g. 30*b*) where, the withdrawal of the bolt and rods having been completed, lug 29 engages lever 70 to cause tongue 12 to be withdrawn into the door.

The dimensions of the parts, particularly gear 22 and toothed-wheel 24, are such that one complete revolution of the key is necessary for effecting the locking and unlocking movements of the locking bar 10 and locking rods 14, 16, 18. Also, the keyhole 9 is dimensioned so that the key cannot be removed except after it has been rotated a complete revolution, thereby assuring that the locking bolt and locking rods cannot be inadvertently left in an intermediate position.

What is claimed is:

1. A rim locking device mountable within, and adjacent to, one side of, a door in a door frame, comprising: a casing including a pair of side plates; a cylinder rotatably disposed between the side plates and having a keyhole for receiving a key to rotate the cylinder; a gear carried by the outer surface of said rotatable cylinder; a toothed-wheel rotatably disposed between the side plates and meshing with said gear for rotation thereby upon rotation of the cylinder by the key; and a plurality of locking bars coupled to said toothed-wheel and projectable thereby into locking engagement with the door frame, one of said locking bars being a short locking bar projectable from and withdrawable into said one side of the door, the remaining locking bars being long locking bars projectable from and withdrawable into the remaining three sides of the door, said toothed-wheel being formed with a cam surface for each locking bar, each locking bar carrying at its inner end a cam follower movable along the respective cam surface of the toothed-wheel, at least one of the side plates being formed with a guiding slot for each locking bar guiding the movement thereof such that the rotation of the toothed-wheel in one direction projects the outer ends of the locking bars from the door into locking engagement with the door frame, and the rotation of the toothed-wheel in the opposite direction withdraws the locking bars into the door; said device further including a tongue projectable from said one side of the door into a recess in the door frame, a spring urging the tongue to its projecting position, a lever pivotable to withdraw the tongue from the door frame, and an abutment carried by said toothed-wheel for pivoting the lever to withdraw the tongue when the toothed-wheel has been rotated in the direction to withdraw the locking bars.

2. A locking device according to claim 1, wherein said cam surfaces in the toothed-wheel are each constituted of a closed slot formed in the toothed-wheel, each closed slot including: a main portion for effecting the projecting and withdrawal movements of its respective locking bar; a dwell portion at the inner end of the slot for causing the locking bar, after completion of its withdrawal movement, to dwell while the toothed-wheel is further rotated to bring said abutment into engagement with the lever to pivot same and thereby to withdraw said tongue; and a locking portion at the outer end of the slot effective, when the locking bar has completed its projecting movement, to lock same in the projected position against any counter-force applied in the locking bar.

3. A locking device according to claim 2, wherein both of said side plates are formed with the guiding slots, and wherein said cam followers are rollers carried by the ends of the respective locking bars and seated within the cam slots of the toothed wheel and the guiding slots of both side plates.

* * * * *